US007310108B2

(12) United States Patent
Moore

(10) Patent No.: US 7,310,108 B2
(45) Date of Patent: Dec. 18, 2007

(54) PRINTING SYSTEM

(75) Inventor: Steven Robert Moore, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 181 days.

(21) Appl. No.: 11/081,473

(22) Filed: Mar. 16, 2005

(65) Prior Publication Data

US 2006/0114313 A1 Jun. 1, 2006

Related U.S. Application Data

(60) Provisional application No. 60/631,656, filed on Nov. 30, 2004.

(51) Int. Cl.
*B41J 2/435* (2006.01)

(52) U.S. Cl. ..... 347/264; 347/262

(58) Field of Classification Search ..... 347/262, 347/264

See application file for complete search history.

(56) References Cited

U.S. PATENT DOCUMENTS 4,579,446 A 4/1986 Fujino et al.
4,586,812 A 5/1986 Kaneko et al.
4,587,532 A * 5/1986 Asano ..... 346/134
4,591,884 A 5/1986 Miyamoto et al.
4,836,119 A 6/1989 Siraco et al.
4,972,236 A 11/1990 Hasegawa
5,004,222 A 4/1991 Dobashi
5,080,340 A 1/1992 Hacknauer et al.
5,095,342 A 3/1992 Farrell et al.
5,150,167 A 9/1992 Gonda et al.
5,159,395 A 10/1992 Farrell et al.
5,208,640 A 5/1993 Horie et al.
5,272,511 A 12/1993 Conrad et al.
5,280,368 A * 1/1994 Fullerton ..... 358/474

(Continued)

FOREIGN PATENT DOCUMENTS

JP 05333643 A 12/1993

(Continued)

OTHER PUBLICATIONS

U.S. Appl. No. 10/761,522, filed Jan. 21, 2004, Mandel, et al.

(Continued)

*Primary Examiner*—Hai Pham
*Assistant Examiner*—Kainoa Wright
(74) *Attorney, Agent, or Firm*—Eugene O. Palazzo; Fay Sharpe LLP

(57) ABSTRACT

A printing system includes first and second marking engines which are operatively connected to each other for printing images onto print media. A print media transport system collects printed media from the marking engines. The print media transport system includes a common paper path which receives printed media from the first and second marking engines. A sensor element is associated with the common paper path for measuring an image quality parameter of printed media traveling thereon and generating a control signal therefrom. An image quality controller is in communication with the sensor element for adjusting image quality parameters in at least one of the first marking engine and second marking engine based on the control signal to reduce a variation in an image quality characteristic of printed images produced by the first and second marking engines.

18 Claims, 4 Drawing Sheets

U.S. PATENT DOCUMENTS 5,287,162 A 2/1994 de Jong et al.
5,326,093 A 7/1994 Sollitt
5,435,544 A 7/1995 Mandel
5,443,254 A 8/1995 Reist
5,467,710 A 11/1995 Wirz
5,473,419 A 12/1995 Russel et al.
5,479,856 A 1/1996 Wirz
5,489,969 A 2/1996 Soler et al.
5,504,568 A 4/1996 Saraswat et al.
5,525,031 A 6/1996 Fox
5,557,367 A 9/1996 Yang et al.
5,568,246 A * 10/1996 Keller et al. ..... 399/382
5,570,172 A 10/1996 Acquaviva
5,574,527 A 11/1996 Folkins
5,596,416 A * 1/1997 Barry et al. ..... 358/296
5,598,257 A 1/1997 Keller et al.
5,629,762 A 5/1997 Mahoney et al.
5,655,208 A 8/1997 Sahay et al.
5,710,968 A 1/1998 Clark et al.
5,730,535 A 3/1998 Keller et al.
5,748,221 A 5/1998 Castelli et al.
5,752,776 A 5/1998 Kunreuther
5,778,377 A 7/1998 Marlin et al.
5,839,016 A 11/1998 Folkins et al.
5,859,711 A 1/1999 Barry et al.
5,884,910 A 3/1999 Mandel
5,940,186 A 8/1999 Barry et al.
5,963,770 A 10/1999 Eakin
5,995,721 A 11/1999 Rourke et al.
6,005,687 A * 12/1999 Kawashima et al. ..... 358/498
6,035,103 A * 3/2000 Zuber ..... 358/1.9
6,059,284 A 5/2000 Wolf et al.
6,097,500 A 8/2000 Fromherz
6,125,248 A 9/2000 Moser
6,212,357 B1 4/2001 Boehmer et al.
6,241,242 B1 6/2001 Munro
6,269,237 B1 7/2001 Olbrich et al.
6,297,886 B1 10/2001 Cornell
6,317,581 B1 11/2001 Boehmer et al.
6,337,958 B1 1/2002 Stanich et al.
6,341,773 B1 1/2002 Aprato et al.
6,344,902 B1 2/2002 Duke et al.
6,384,918 B1 5/2002 Hubble, III et al.
6,450,711 B1 9/2002 Conrow
6,456,310 B1 9/2002 Wallace et al.
6,476,376 B1 11/2002 Biegelsen et al.
6,476,923 B1 11/2002 Cornell
6,493,098 B1 12/2002 Cornell
6,501,929 B1 12/2002 Warbus et al.
6,537,910 B1 3/2003 Burke et al.
6,550,762 B2 4/2003 Stoll
6,550,764 B2 4/2003 Wilson et al.
6,554,276 B2 4/2003 Jackson et al.
6,567,621 B2 5/2003 Miyoshi et al.
6,577,925 B1 6/2003 Fromherz
6,606,165 B1 8/2003 Barry et al.
6,607,320 B2 8/2003 Bobrow et al.
6,608,988 B2 8/2003 Conrow
6,612,566 B2 9/2003 Stoll
6,612,571 B2 9/2003 Rider
6,618,167 B1 9/2003 Shah
6,621,576 B2 9/2003 Tandon et al.
6,633,382 B2 10/2003 Hubble, III et al.
6,639,669 B2 10/2003 Hubble, III et al.
6,654,136 B2 11/2003 Shimada
6,675,957 B2 1/2004 Greive et al.
6,697,582 B1 2/2004 Scheuer
6,714,834 B1 3/2004 Roth et al.
6,760,553 B2 * 7/2004 Mitsuya et al. ..... 399/38
6,819,906 B1 11/2004 Herrmann et al.
6,925,283 B1 8/2005 Mandel et al.
6,959,165 B2 10/2005 Mandel et al.
6,973,286 B2 12/2005 Mandel et al.
7,024,152 B2 4/2006 Lofthus et al.
7,123,873 B2 10/2006 deJong et al.
2002/0015177 A1 2/2002 Yamakado et al.
2002/0078012 A1 6/2002 Ryan et al.
2002/0103559 A1 8/2002 Gartstein
2003/0007154 A1 1/2003 Tandon et al.
2003/0049039 A1 * 3/2003 Suzuki ..... 399/49
2003/0063275 A1 4/2003 Hubble, III et al.
2003/0077095 A1 4/2003 Conrow
2003/0095722 A1 5/2003 Regimbal
2003/0128993 A1 7/2003 Mitsuya et al.
2003/0133731 A1 7/2003 Nakazawa et al.
2004/0085561 A1 5/2004 Fromherz
2004/0085562 A1 5/2004 Fromherz
2004/0088207 A1 5/2004 Fromherz
2004/0150156 A1 8/2004 Fromherz et al.
2004/0150158 A1 8/2004 Biegelsen et al.
2004/0153983 A1 8/2004 McMillan
2004/0216002 A1 10/2004 Fromherz et al.
2004/0225391 A1 11/2004 Fromherz et al.
2004/0225394 A1 11/2004 Fromherz et al.
2004/0247365 A1 12/2004 Lofthus et al.
2004/0257596 A1 12/2004 Mestha et al.
2006/0033771 A1 2/2006 Lofthus et al.
2006/0034631 A1 * 2/2006 Lofthus et al. ..... 399/84
2006/0067756 A1 3/2006 Anderson et al.
2006/0067757 A1 3/2006 Anderson et al.
2006/0114313 A1 6/2006 Moore
2006/0114497 A1 6/2006 Anderson et al.
2006/0115284 A1 6/2006 Grace et al.
2006/0115287 A1 6/2006 Roof
2006/0115288 A1 6/2006 Roof
2006/0132815 A1 6/2006 Lofthus et al.
2006/0176336 A1 8/2006 Moore et al.
2006/0197966 A1 9/2006 Viturro et al.
2006/0209101 A1 9/2006 Mizes
2006/0214359 A1 9/2006 Clark
2006/0214364 A1 9/2006 Clark et al.
2006/0215240 A1 9/2006 Mongeon
2006/0221159 A1 10/2006 Moore et al.
2006/0221362 A1 10/2006 Julien et al.
2006/0222384 A1 10/2006 Moore et al.
2006/0222393 A1 10/2006 de Jong et al.
2006/0230201 A1 10/2006 Fromherz et al.

FOREIGN PATENT DOCUMENTS

JP 2003140415 A 5/2003
JP 2003156969 A 5/2003
JP 2004226484 A 8/2004
JP 2004226826 A 8/2004

OTHER PUBLICATIONS

Morgan, P.F., "Integration of Black Only and Color Printers", Xerox Disclosure Journal, vol. 16, No. 6, Nov./Dec. 1991, pp. 381-383.
Desmond Fretz, "Cluster Printing Solution Announced", Today at Xerox (TAX), No. 1129, Aug. 3, 2001.
U.S. Appl. No. 10/917,768, filed Aug. 13, 2004, Lofthus, et al.
U.S. Appl. No. 10/924,106, filed Aug. 23, 2004, Lofthus, et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,450, filed Nov. 30, 2004, Lofthus et al.
U.S. Appl. No. 11/000,168, filed Nov. 30, 2004, Biegelsen et al.

* cited by examiner

PRINTING SYSTEM

CROSS-REFERENCE TO RELATED APPLICATIONS

This application claims the priority of U.S. Provisional Application Ser. No. 60/631,656, entitled "MULTI-PURPOSE MEDIA TRANSPORT HAVING INTEGRAL IMAGE QUALITY SENSING CAPABILITY," filed Nov. 30, 2004, the disclosure of which is incorporated herein in its entirety, by reference.

The following applications, the disclosures of each being totally incorporated herein by reference are also mentioned:

- U.S. application Ser. No. 10/917,676, filed Jan. 13, 2005, entitled "MULTIPLE OBJECT SOURCES CONTROLLED AND/OR SELECTED BASED ON A COMMON SENSOR," by Robert M. Loftus, et al;
- U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES," by David G. Anderson, et al.,
- U.S. patent application Ser. No. 10/953,953, filed Sep. 29, 2004, entitled "CUSTOMIZED SET POINT CONTROL FOR OUTPUT STABILITY IN A TIPP ARCHITECTURE," by David G. Anderson et al.;
- U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE", by David G. Anderson et al.;
- U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE", by David G. Anderson et al.;
- U.S. patent application Ser. No. 11/000,158, filed Nov. 30, 2004, entitled "GLOSSING SYSTEM FOR USE IN A TIPP ARCHITECTURE," by Bryan J. Roof;
- U.S. patent application Ser. No. 11/000,258, filed Nov. 30, 2004, entitled "GLOSSING SYSTEM FOR USE IN A TIPP ARCHITECTURE," by Bryan J. Roof,
- U.S. patent application Ser. No. 10/999,450, filed Nov. 30, 2004, entitled "ADDRESSABLE FUSING FOR AN INTEGRATED PRINTING SYSTEM," by Robert M. Lofthus, et al.;
- U.S. patent application Ser. No. 11/000,168, filed Nov. 30, 2004, entitled "ADDRESSABLE FUSING AND HEATING METHODS AND APPARATUS," by David K. Biegelsen, et al.;
- U.S. patent application Ser. No. 10/917,768, filed Aug. 13, 2004, for PARALLEL PRINTING ARCHITECTURE CONSISTING OF CONTAINERIZED IMAGE MARKING ENGINES AND MEDIA FEEDER MODULES, by Robert M. Lofthus, et al.; and
- U.S. patent application Ser. No. 10/924,459, filed Aug. 23, 2004, entitled "PARALLEL PRINTING ARCHITECTURE USING IMAGE MARKING ENGINE MODULES," by Barry Mandel, et al.

BACKGROUND

This disclosure relates generally to an integral printing architecture containing at least a first marking engine and a second marking engine and more particularly concerns a media transport having an image quality sensing capability.

In a typical xerographic marking engine, such as a copier or printer, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a developing material. Generally, the developing material comprises toner particles adhering triboelectrically to carrier granules. The developed image is subsequently transferred to a print medium, such as a sheet of paper. The fusing of the toner onto paper is generally accomplished by applying heat to the toner with a heated roller and application of pressure. In multi-color printing, successive latent images corresponding to different colors are recorded on the photoconductive surface and developed with toner of a complementary color. The single color toner images are successively transferred to the copy paper to create a multi-layered toner image on the paper. The multi-layered toner image is permanently affixed to the copy paper in the fusing process.

A common trend in the office equipment market, particularly in relation to copiers and printers, is to organize a machine on a modular basis, wherein certain distinct subsystems of the machine are bundled together into modules which can be readily removed from the machine and replaced with new modules of the same type. A modular design facilitates servicing and repair, since a representative of the service provider simply removes the defective module. Actual repair of the module can take place off site, at the service provider's premises.

As demands for high speed copiers and printers have increased, the size and complexity of such systems have increased. As the size and complexity increases, the associated expense is often justified by only a small percentage of customers that offer extremely high volume printing. Recently, systems have been developed which include a plurality of marking engines. These systems enable high overall outputs to be achieved by printing portions of the same document on multiple printers. Such systems are commonly referred to as "tandem engine" printers, "parallel" printers, or "cluster printing" (in which an electronic print job may be split up for distributed higher productivity printing by different marking engines, such as separate printing of the color and monochrome pages). These systems have been designed primarily for the office market. A common trend in the office equipment field is to organize a printing system on a modular basis. Certain distinct subsystems of the machine are bundled together into modules which can be readily removed from the machine and replaced with new modules of the same type. A modular design facilitates a greater flexibility in the operation and maintenance of the machine. Such a system is disclosed in above-mentioned application Ser. No. 10/924,459.

Where two or more marking engines are employed in the generation of a document, the eye may detect inconsistencies between the images produced by different marking engines.

SUMMARY

Aspects of the present disclosure in embodiments thereof include a printing system and a method of printing and in particular, to a printing system which includes first and second marking engines. The marking engines are operatively connected to each other for printing images onto print media. A print media transport system collects printed media from the marking engines. The print media transport system includes a common paper path which receives printed media from the first and second marking engines. A sensor element is associated with the common paper path for measuring an image quality parameter of printed media traveling thereon and generating a control signal therefrom. An image quality controller is in communication with the sensor element for adjusting image quality parameters in at least one of the first marking engine and second marking engine based on the control signal to reduce a variation in an image quality characteristic of printed images produced by the first and second marking engines.

In aspects disclosed herein, the method of printing includes applying images to print media with a first marking engine, applying images to print media with a second print engine, conveying the print media from the first and second print engines along a common pathway to an image quality sensor, adjusting a velocity of the print media adjacent the image quality sensor, sensing an image quality parameter of the print media with the sensor, and controlling at least one of the first and second marking engines to reduce a variation in an image quality characteristic of printed images produced by the first and second marking engines.

In other aspects disclosed herein, the printing system includes a plurality of marking engines. A print media transport system receives print media from the plurality of marking engines and outputs print media from the plurality of marking engines in a common stream. An image quality sensor is associated with the print media transport system for sensing an image quality parameter of print media. An image quality controller controls at least one of the marking engines in response to the sensed image quality parameter of the print media. A drive element associated with the image quality sensor selectively adjusts a velocity of print media adjacent the image quality sensor.

DETAILED DESCRIPTION

Figure 1:
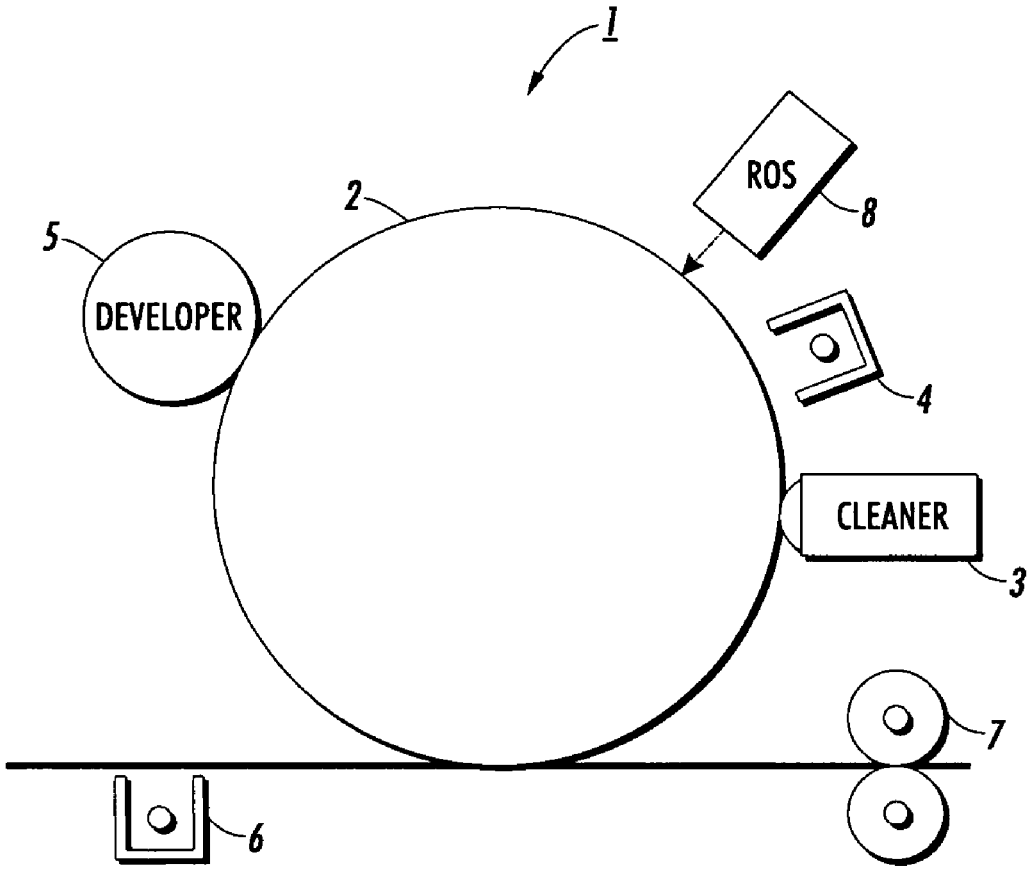
FIG. 1 is a simplified partially-elevational, partially-schematic view of an integrated marking engine of which two or more may be employed in embodiments disclosed herein.

In a printing system consisting of multiple marking engines, it is desirable for output print media from different marking engines to be merged into the same document. In general, documents produced by a modular printing system may contain output contributed by different marking engines. If, for example, there is a logo or other graphic entity that is common to multiple pages within the document, then an observer may notice page to page differences in the appearance of this entity. This is especially so for color content but it may also be noticeable in black and white. Thus, the desire for page to page appearance consistency within a document represents a significant barrier to a modular approach of multiple marking engines producing sheets collaboratively.

To reduce inconsistencies between the image outputs of marking engines which may be nominally the same, a measure of actual output image quality from each engine can be made. Each marking engine can be adjusted, as needed, such that output from different engines falls within certain acceptable tolerance ranges so as to be indistinguishable to the customer. It is advantageous for the measurement of image quality to be performed in a manner which is transparent to the user, for example, without appreciably reducing the productivity of the printing system. In one embodiment, output sheets from all engines are routed to an internal sensor element and scanned for image quality attributes.

The printing system may incorporate "tandem engine" printers, "parallel" printers, "cluster printing," "output merger," or "interposer" systems, and the like, as disclosed, for example, in U.S. Pat. Nos. 4,579,446; 4,587,532; 5,489,969 5,568,246; 5,570,172; 5,596,416; 5,995,721; 6,554,276, 6,654,136; 6,607,320, and in copending U.S. application Ser. No. 10/924,459, filed Aug. 23, 2004, for Parallel Printing Architecture Using Image Marking Engine Modules by Mandel, et al., and application Ser. No. 10/917,768, filed Aug. 13, 2004, for Parallel Printing Architecture Consisting of Containerized Image Marking Engines and Media feeder Modules, by Robert Lofthus, the disclosures of all of these references being incorporated herein by reference. A parallel printing system feeds paper from a common paper stream to a plurality of printers, which may be horizontally and/or vertically stacked. Printed media from the various printers is then taken from the printer to a finisher where the sheets associated with a single print job are assembled. Variable vertical level, rather than horizontal, input and output sheet path interface connections may be employed, as disclosed, for example, in U.S. Pat. No. 5,326,093 to Sollitt.

The terms "print medium," "sheet," and "substrate" are used herein to refer to a usually flimsy physical sheet of paper, plastic, or other suitable physical print media substrate for images, whether precut or web fed. A "print job" or "document" is normally a set of related sheets, usually one or more collated copy sets copied from a set of original print job sheets or electronic document page images, from a particular user, or otherwise related.

The sensor may impose constraints upon sheet transport during scanning. For example, the sheet may need to pass the sensor more slowly than would be the case for normal productivity and may need to be held accurately at the focal depth of the sensor optics. In contrast, a general sheet transport in a system is characterized by high speed and generous baffle gaps for reliability. A compact, flexible approach is suggested that provides a general transport that satisfies the apparently mutually exclusive requirements for both high speed transport and sensing capabilities.

Figure 2:
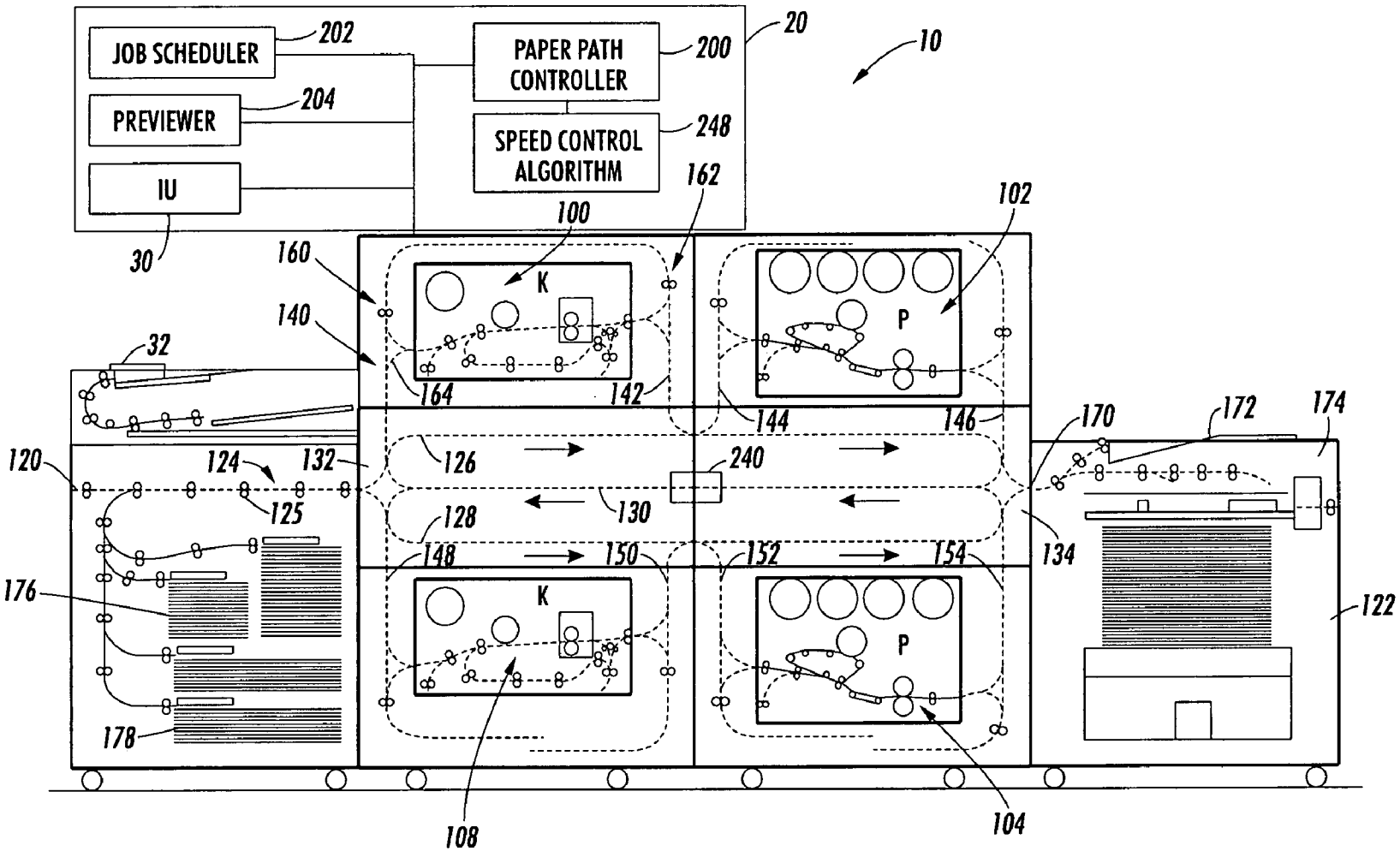
FIG. 2 is a sectional view showing an arrangement of an image marking system according to one embodiment including four of the marking engines of FIG. 1.

FIG. 1 is a simplified partially-elevational, partially-schematic view of a marking engine 1 which may be employed in a printing system, such as an electrophotographic printing apparatus of the type illustrated in FIG. 2. While FIG. 2 illustrates a combination digital copier/printer, the printing system may alternatively be a copier or printer that outputs prints in whatever manner, such as a digital printer, facsimile, or multifunction device, and can create images electrostatographically, by ink-jet, hot-melt, or by any other method. The marking media used by the marking engine can include toner particles, solid or liquid inks, or the like.

The illustrated marking engine 1 serves as a replaceable xerographic module in the printing system. As is familiar in the art of electrostatographic printing, contained within the marking engine 1 are many of the hardware elements employed in the creation of desired images by electrophotographical processes. In the case of an electrographic device, the printer typically includes a charge retentive surface, such as a rotating photoreceptor 2 in the form of a belt or drum. The images are created on a surface of the photoreceptor. Disposed at various points around the circumference of photoreceptor 2 are xerographic subsystems which include a cleaning device generally indicated as 3, a charging station for each of the colors to be applied (one in the case of a monochrome printer, four in the case of a CMYK printer), such as a charging corotron 4, an exposure station 8, which forms a latent image on the photoreceptor, a developer unit 5, associated with each charging station for developing the latent image formed on the surface of the photoreceptor by applying a toner to obtain a toner image, a transferring unit, such as a transfer corotron 6 transfers the toner image thus formed to the surface of a print media substrate, such as a sheet of paper, and a fuser 7 fuses the image to the sheet.

It will be appreciated that, in any particular embodiment of an electrophotographic printer, there may be variations on this general outline, such as additional corotrons, or cleaning devices, or, in the case of a color printer, multiple developer units. Xerographic subsystems are controlled by a CPU which adjust various xerographic parameters. For example, PR charge levels, exposure levels Developed Mass Area (DMA), transfer currents, and fuser temperature can be adjusted to produce high quality prints.

With particular reference to developer unit 5, as is familiar in the art, the unit 5 generally comprises a housing in which a supply of developer (which typically contains toner particles plus carrier particles) which can be supplied to an electrostatic latent image created on the surface of photoreceptor 2 or other charge receptor. Developer unit 5 may be made integral with or separable from xerographic module 1. In the case of a color-capable module, the xerographic module includes multiple developer units 5, each unit developing the photoreceptor 2 with toner of a different primary color.

With reference to FIG. 2 the printing system 10 includes a plurality of marking engines 100, 102, 104, 108, which may be configured as shown in FIG. 1. The various marking engines are associated for integrated parallel printing of documents within the printing system 10 and are operatively connected to one another, such as under the control of a common control system 20, which may be located in a suitable central processor, such as a CPU. It will be appreciated that various parts of the control system 20 may be distributed, for example, located in the marking engines, and connected with the central processor by suitable links.

Each marking engine 100, 102, 104, 108 can receive image data, which can include pixels, in the form of digital image signals for processing from the computer network/server by way of a suitable communication channel, such as a telephone line, computer cable, ISDN line, etc. Typically, computer networks include clients who generate jobs, wherein each job includes the image data in the form of a plurality of electronic pages and a set of processing instructions. In turn, each job is converted into a representation written in a page description language (PDL) such as PostScript® containing the image data. Where the PDL of the incoming image data is different from the PDL used by the digital printing system, a suitable conversion unit converts the incoming PDL to the PDL used by the digital printing system. The suitable conversion unit may be located in an interface unit (IU) 30 in the control system 20. Other remote sources of image data such as a floppy disk, hard disk, storage medium, scanner, etc. may be envisioned.

For on-site image input, an operator may use a scanner 32 to scan documents, which provides digital image data including pixels to the interface unit. Whether digital image data is received from a scanner or computer network, the interface unit processes the digital image data in the form required to carry out each programmed job. The interface unit 30 can be part of the digital printing system. However, the computer network or the scanner may share the function of converting the digital image data into a form, which can be utilized by the digital printing system 10.

In the architecture of FIG. 2, four marking engines 100, 102, 104, and 108 are shown interposed between a feeder module 120 and a finishing module 122. In the embodiment shown in FIG. 2, marking engines 100, and 108 are black (K) marking engines and marking engines 102, 104 are process color marking engines (P), although the system may alternatively or additionally include one or more magnetic ink character recognition (MICR) marking engines (M), or custom color marking engines (C).

Process color marking engines generally employ three inks or toners (which may be referred to generally as marking media), magenta, cyan, and yellow (i.e., CMY), and frequently also black (i.e., CMYK). Different colors are achieved by combinations of the three primary colors provided by three different toners. Black printing is achieved using a black (K) toner, where available, or in color marking engines which lack a black toner, by a combination of CMY which approximates black. Monochrome marking engines, such as black and custom color marking engines, may be fed with an alternatively dyed or pigmented ink or toner, or a premixed ink or toner, which provides a specific color, generally with a higher color rendering accuracy than can be achieved with a process color marking engine. Custom color (C) here is used interchangeably with other terms in the trade, such as signature color, highlight color, or Pantone™ color. MICR printing applies a magnetic pattern or other detectable portion to the page, for example, as a security feature for bank notes.

The marking engines 100, 102, 104, 108, are connected with each other and with a feeder module 120 and a finishing module 122 by a print media transport system 124 including a network of paper pathways. In its simplest form, the network 124 enables the printed media outputs of two or more marking engines of the same print modality (such as black or process color) to be combined as a common stream so that they can be assembled, for example at the finisher 122, into the same document. In the illustrated embodiment, the network 124 enables print media to travel from the feeder module 120 to any one of the marking engines and between any marking engine and any other marking engine in the system, although more limited pathways may be provided, depending on the requirements of the system. Additionally, the network 124 enables print media to be printed by two or more of the marking engines contemporaneously. For example, process color (P) printing can be performed by marking engine 102 on a portion of a print job, while at the same time, process color printing is performed by marking engine 104 on another portion of the print job.

The paper pathway network 124 includes a plurality of drive elements 125, illustrated as pairs of rollers, although other drive elements, such as airjets, spherical balls, belts, and the like are also contemplated. The paper pathway network 124 may include at least one downstream print media highway 126, 128 (two in the illustrated embodiment), and at least one upstream print media highway 130, along which the print media is conveyed in a generally opposite direction to the downstream highways 126, 128. The highways 126, 128, 130 are arranged generally horizontally, and in parallel in the illustrated embodiment, although it is also contemplated that portions of these highways may travel in other directions, including vertically. The main highways 126, 128, 130 are connected at ends thereof with each other, and with the feeder module 120 and finisher module 122, by cloverleaf connection pathways 132, 134.

Pathways 140, 142, 144, 146, 148, 150, 152, 154 etc. feed the print media between the highways 126, 128, 130 and the marking engines 100, 102, 104, 108. The highways 126, 128, 130 and/or pathways 140, 142, 144, 146, 148, 150, 152, 154 may include inverters, reverters, interposers, bypass pathways, and the like as known in the art to direct the print media between the highway and a selected marking engine or between two marking engines. For example, as shown in FIG. 2, each marking engine has an input side inverter 160 and an output side inverter 162 connected with the respective input and output pathways. The network 124 is structured such that one or both the inverters 160, 162 can be bypassed, in the illustrated embodiment, by incorporation of bypass pathways 164 on the input and/or output sides respectively.

As the print media is being processed for image transfer through the marking engine 100, the print media may be transported at a relatively slower speed, herein referred to as engine marking speed. However, when outside of the marking engine 100, the print media can be transported through the interconnecting high speed highways at a relatively higher speed. In inverter assembly 160 print media exiting the highway 126 at a highway speed can be slowed down before entering marking engine 100 by decoupling the print media at the inverter from the highway 126 and by receiving the print media at one speed into the inverter assembly, adjusting the reversing process direction motor speed to the slower marking engine speed and then transporting the print media at slower speed to the marking engine 100. Additionally, if a sheet has been printed in marking engine 100, it can exit the marking engine at the marking engine speed and can be received in the exit inverter assembly 162 at the marking engine speed, be decoupled from the marking engine and transported for re-entering the high speed highway at the highway speed. Additionally, any one of the inverter assemblies shown could also be used to register the sheet in skew or in a lateral direction.

Print media from the various marking engines and highways is collected as a common stream and delivered by an exit pathway 170 to the finisher module 122. The finisher module may include one or a plurality of output destinations, herein illustrated as output trays 172, 174. In one embodiment, one or more of the output trays 172 is used as a purge tray. As is known in the art, the finisher can include any post-printing accessory device such as a sorter, mailbox, inserter, interposer, folder, stapler, stacker, hole puncher, collater, stitcher, binder, envelope stuffer, postage machine, or the like.

The feeder module 120 may include one or more print media sources, such as paper trays 176, 178, etc. While in the illustrated embodiment, all of the marking engines 100, 102, 104, 108 are fed from a common high speed feeder module 120, it is also contemplated that the marking engines may be associated with separate print media feeders.

The possible paths in which sheets can be directed through network 124 is controlled by a paper path controller 200 which controls the functions of paper handling as mentioned above. Paper path controller 200 is responsive to a job scheduler 202 which includes a function of routing sheets to and from marking engines 100, 102, 104, and 108 by utilizing pathways of the network 124. The sheets may be routed to two or more marking engines, for example, to provide single pass duplex printing (each of two marking engines prints one side of a sheet) or to provide composite images (multiple images on the same side of a sheet).

The possible paths in which documents can be directed through the network 124 is controlled by a paper path controller 200 which controls the functions of paper handling. Paper path controller 200 is responsive to a job scheduler 202, which includes a function of routing documents to and from each marking engines 100, 102, 104, and 108 by utilizing appropriate pathways of the network 124. In turn, job scheduler receives information about the document to be printed from the previewer 204, which may located along with the job scheduler 202 and paper path controller 200 within the overall control system 20 for the printing system or elsewhere, such as in the network server or in individual workstations linked thereto. Various methods of scheduling print media sheets may be employed. For example, U.S. Pat. No. 5,095,342 to Farrell, et al.; U.S. Pat. No. 5,159,395 to Farrell, et al.; U.S. Pat. No. 5,557,367 to Yang, et al.; U.S. Pat. No. 6,097,500 to Fromherz; and U.S. Pat. No. 6,618,167 to Shah; and above mentioned U.S. application Ser. Nos. 10/284,560; 10/284,561; and 10/424,322 to Fromherz, all of which are incorporated herein in their entireties by reference, disclose exemplary job scheduling systems which can be used to schedule the print sequence herein, with suitable modifications, such as to include scheduling of the routing of print media to a sensor module 240.

The sensor module 240 is located within the network 124, such as on one of the main highways 126, 128, 130, e.g., highway 130, although other locations are contemplated, such as in exit pathway 170. The highway selected is one which is accessible from all the marking engines. Additionally, a highway which, in normal operation, is less frequently used for transporting print media than other highways, such as return highway 130, is particularly suitable. This is because the sensor module 240 may place special transport requirements on the highway, such as reducing the speed of print media to be sensed.

Figure 3:
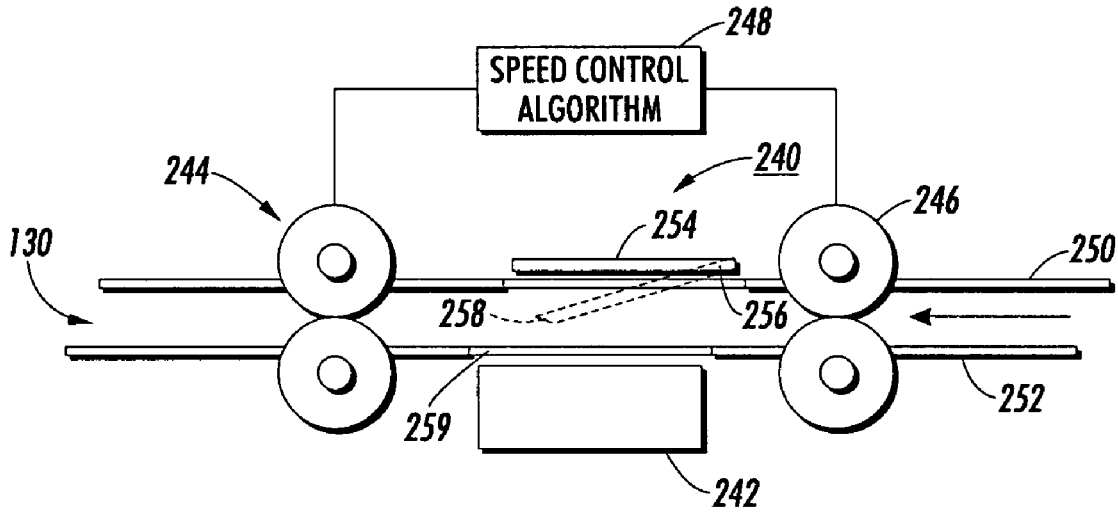
FIG. 3 is a schematic view of the sensor module of FIG. 2.

In one embodiment, illustrated in FIG. 3, the sensor module 240 includes a sensor element 242, which detects one or more image quality parameters of the printed media, such as a gloss, reflectance at specific wavelengths (color), image geometries (such as image to print media alignment, size of image, e.g., whether it has been magnified or reduced), and the like. Gloss can be determined in a number of ways, for example, specular gloss is the percentage of the intensity of the incident light (at a specified angle of incidence, e.g., at 20, 60, or 85 degrees, and in a specified wavelength range) which is reflected from the surface. The sensor element 242 may alternatively or additionally include means for measuring other optical appearance properties, such as a calorimeter, spectrophotometer and/or other means for generating and processing color information.

The sensor element 242 may be a full width array sensor which is capable of scanning the full cross-process width of the sheet. Sensor module 240 also includes drive elements 244, 246, illustrated as pairs of rollers, although other drive elements, such as airjets, spherical balls, belts, and the like are also contemplated. During a scanning operation by the sensor element, the feeder rollers 244 decelerate the sheet so that it can be scanned at a predetermined velocity. Feeder rollers 246 accelerate the sheet to the original velocity after the sheet has been scanned. In practice, there may be several pairs of inlet and outlet feeder rollers 244, 246.

In operation, a speed control algorithm 248 controls the velocity at which the sheet passes through sensor module 240 such that sheets not scheduled to be sensed travel at a higher velocity through highway 130 than sheets being scanned, which are decelerated to a lower scan speed and then reaccelerated to the higher velocity after scanning. The printed media is constrained for travel in the direction of flow in highway 130, and in other paths of the network, by upper and lower baffles 250, 252. The sensor module 240 may also include an actuable backer ski 254, in the form of a movable baffle. During scanning, the movable baffle is lowered into the paper path of highway 126 by a solenoid (not shown) or other suitable actuator. This temporarily decreases the pathway's width, in a direction perpendicular to the direction of paper flow, adjacent the sensor element 242. Movable baffle 254 thus constricts the sheet location relative to the sensor element focal point, as shown in FIG. 3. For example, the movable baffle 254 pivots about a pivot point 256 upstream of the sensor such that a free end 258 of the movable baffle is lowered (shown in phantom) until it is closely adjacent a window 259 in the lower baffle 252, leaving a narrow gap through which the sheet to be sensed is channeled.

Figure 4:
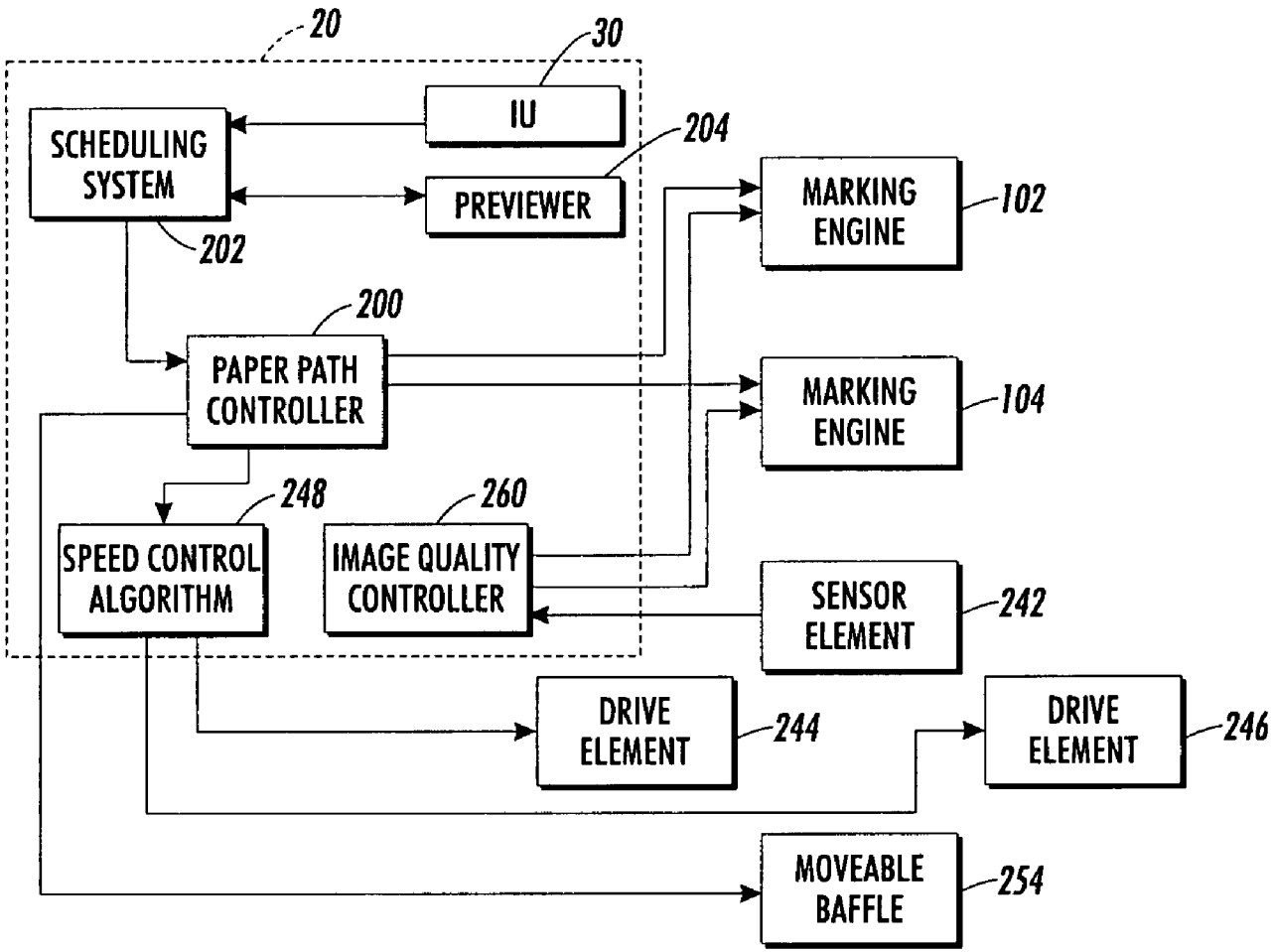
FIG. 4 is a schematic view of the control system and some of the image marking system of FIG. 2 showing links to operating components.

The sensor module 240 senses/measures image quality parameters, such as gloss, of printed sheets traveling therethrough and generates a control signal therefrom. In generating the control signal, the sensed parameters may be compared with sensed parameters of printed sheets from another marking engine, such as one of the same print modality, or with sensed parameters generated from a test sheet. An image quality controller 260 (FIG. 4), in communication with the sensor module identifies which marking engine produced the printed sheet sensed and adjusts image quality parameters of the marking engine, e.g., by adjusting machine actuators associated with the marking engines that effect image quality parameters in the marking engines based on the control signal. The scheduling system 202 communicates with the controller 260 sufficient information on the routing of print media for determining the marking engine which produced the printed sheet being sensed.

For example, if the sensor element detects an image quality parameter, such as gloss level or color values of a sheet coming from one process color marking engine which is outside a pre-specified tolerance range for the image quality parameters of the process color printers in the system (or which falls outside an acceptable range of variation from another process color marking engine in the system), the image quality controller may adjust a machine actuator for the marking engine from which the sheet came to bring the marking engine within specification (or adjust an actuator of that and/or another marking engine to achieve more consistent image quality parameters). In the case of gloss, the machine actuator may be, for example, an actuator for a fuser roll heater. Since gloss generally increases with increasing fuser roll temperature, a low gloss measurement may be addressed by increasing the fuser roll temperature, and vice versa. Other factors which affect gloss include pressure on the fuser rolls and dwell time in the fuser roll nip, which may be alternatively or additionally controlled to achieve a desired gloss level. In the case of color, the machine actuators may adjust the tone reproduction curve for the marking engine.

In addition to sensing gloss on printed substrates which are output to the finisher, as described above, the sensor module 240 can be utilized in the system 10 to scan test images printed with test patterns from each marking engine. The test images are compared to reference values for calibration of the marking engines. The image quality controller makes any appropriate changes to adjust various xerographic parameters in each marking engine to adjust the image quality, based on the sensed measurements. The test sheets are directed, after testing, to the discard tray.

In one embodiment, the sensed print media from the sensing element form a part of an assembled document, i.e., are routed to the finisher along with other printed media. In one embodiment, only a portion of the printed sheets are sensed with the sensor. In another embodiment, the sheets which have been sensed may be discarded by routing to a discharge path (not shown).

It is contemplated that each marking engine may record a marking engine identifier on the print media. For example, a printed marker could be embedded in the image to be scanned which would identify which marking engine produced the sensed sheet. However, such an identifier is not necessary where the scheduling system allows tracking of the location of sheets and their movement through the system.

The scheduling system 202 may schedule selected substrates to be measured by the sensor element and plan the slowing down and speeding up of the print media as it passes the sensor without substantially affecting the overall productivity of the system.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A printing system comprising:

a first marking engine;

a second marking engine; the first and second marking engines being operatively connected to each other for printing images onto print media;

a print media transport system which collects printed media from the first and second marking engines, the print media transport system including a common paper path which receives printed media from the first and second marking engines;

a sensor element, associated with the common paper path, for measuring an image quality parameter of printed media traveling thereon and generating a control signal therefrom;

a movable baffle, adjacent the sensor element, for selectively reducing a width of the common paper path; and an image quality controller, in communication with the sensor element, for adjusting image quality parameters in at least one of the first marking engine and second marking engine based on the control signal to reduce a variation in an image quality characteristic of printed images produced by the first and second marking engines.

2. The printing system of claim 1, wherein the control signal includes data associating the printed media traveling through the common paper path with either the first marking engine or the second marking engine.

3. A printing system comprising:

a first marking engine;

a second marking engine, the first and second marking engines being operatively connected to each other for printing images onto print media;

a print media transport system which collects printed media from the first and second marking engines, the print media transport system including a common paper path which receives printed media from the first and second marking engines;

a sensor element, associated with the common paper path, for measuring an image quality parameter of printed media traveling thereon and generating a control signal therefrom;

the common paper path includes a drive element for moving print media at a first predefined velocity past the sensor element when the print media is to be measured and at a second predefined velocity past the sensor element when the print media is not to be measured; and an image quality controller, in communication with the sensor element, for adjusting image quality parameters in at least one of the first marking engine and second marking engine based on the control signal to reduce a variation in an image quality characteristic of printed images produced by the first and second marking engines.

4. The printing system of claim 3, wherein the drive element includes a first pair of drive rollers in the common paper path upstream of the sensor element and a second pair of drive rollers in the common paper path downstream of the sensor element.

5. The printing system of claim 3, wherein the first predefined velocity is lower than the second predefined velocity.

6. The printing system of claim 3, further comprising a movable baffle, adjacent the sensor element, for selectively reducing a width of the common paper path.

7. The printing system of claim 1, wherein the moveable baffle includes means for moving the baffle to deflect print media to a position which is closer to the sensor element.

8. The printing system of claim 1, wherein the moveable baffle pivots such that a downstream end of the baffle is moved closer to the sensor element.

9. The printing system of claim 1, wherein the sensor element includes a full width array sensor.

10. The printing system of claim 1, further comprising a sheet scheduler for scheduling selected print media to be measured by the sensor element.

11. The printing system of claim 1, further comprising a finisher which receives printed media from the first and second marking engines.

12. The printing system of claim 11, wherein the finisher receives printed media from the sensor element.

13. The printing system of claim 1, wherein the first and second marking engines are of the same print modality, selected from process color, custom color, and black.

14. The printing system of claim 1, wherein the common paper path transports printed media in an upstream direction.

15. The printing system of claim 1, wherein the image quality parameter comprises at least one of the group consisting of gloss, reflectance at specific wavelengths, and image geometrics.

16. A method of printing comprising:

applying images to print media with a first marking engine;

applying images to print media with a second print engine;

conveying the print media from the first and second print engines along a common pathway to an image quality sensor;

adjusting a velocity of the print media adjacent the image quality sensor;

sensing an image quality parameter of the print media with the sensor;

selectively constricting the common pathway adjacent the sensor; and controlling at least one of the first and second marking engines to reduce a variation in an image quality characteristic of printed images produced by the first and second marking engines.

17. A method of printing comprising:

applying images to print media with a first marking engine;

applying images to print media with a second print engine;

conveying the print media from the first and second print engines along a common pathway to an image quality sensor;

sensing an image quality parameter of the print media with the sensor;

selectively controlling a velocity of the print media in the common pathway adjacent the sensor such that print media not scheduled to be sensed travels at a higher velocity past the sensor than print media being sensed; and controlling at least one of the first and second marking engines to reduce a variation in an image quality characteristic of printed images produced by the first and second marking engines.

18. The method of claim 17, further comprising:

selectively constricting the common pathway adjacent the sensor.

* * * * *